United States Patent [19]

Brossmer et al.

[11] 4,332,151

[45] Jun. 1, 1982

[54] APPARATUS FOR HEAT TREATMENT OF SYNTHETIC YARNS AND FIBERS

[75] Inventors: Max Brossmer, Hanau; Manfred Boerner, Offenbach, both of Fed. Rep. of Germany

[73] Assignee: D.I.E.N.E.S Apparatebau GmbH, Muehlheim, Fed. Rep. of Germany

[21] Appl. No.: 213,264

[22] Filed: Dec. 5, 1980

[30] Foreign Application Priority Data

Sep. 5, 1980 [DE] Fed. Rep. of Germany ..... 3033409

[51] Int. Cl.[3] ..... D06B 23/18

[52] U.S. Cl. ..... 68/5 E; 34/242; 432/242

[58] Field of Search ..... 68/5 E, 6, DIG. 1; 34/242; 432/242

[56] References Cited

U.S. PATENT DOCUMENTS

| | | | |
|---|---|---|---|
| 3,032,890 | 5/1962 | Brick et al. | 34/242 X |
| 3,126,724 | 3/1964 | Kolonits | 34/242 X |
| 3,230,745 | 1/1966 | Bittle et al. | 68/5 E |
| 3,349,578 | 10/1967 | Greer et al. | 34/242 X |
| 3,927,540 | 12/1975 | Tanaka et al. | 68/5 E |

FOREIGN PATENT DOCUMENTS

| | | | |
|---|---|---|---|
| 342687 | 6/1972 | U.S.S.R. | 68/5 E |

*Primary Examiner*—Philip R. Coe

*Attorney, Agent, or Firm*—Trevor B. Joike

[57] ABSTRACT

For heating synthetic yarns and fibers an elongated vessel filled with saturated steam is provided through which the yarn is continuously drawn. The steam condensates on the yarn and transfers its condensation heat to the yarn. For sealing the vessel (3) at the inlet (2) and the outlet (4), several apertures (6–9, 13–16) are provided in a pair of tubes (5,12) surrounding the traveling path of the yarn (1). The space between the first aperture and the opening adjacent the steam vessel (3) is connected to a blocking liquid supply pipe (30) and the space between the last aperture (9,16) and the inlet hole (10) and the outlet hole (17), respectively, for the yarn is connected to a blocking liquid return pipe (31). The blocking liquid supply pipe is kept under a pressure which is somewhat higher than the pressure within the steam vessel (3). The blocking liquid pressure is reduced stepwise by the apertures connected in series and the blocking liquid return pipe (31) ports into a blocking liquid collector tank (32) which is under atmospheric pressure. Preferably water is used as blocking liquid.

9 Claims, 1 Drawing Figure

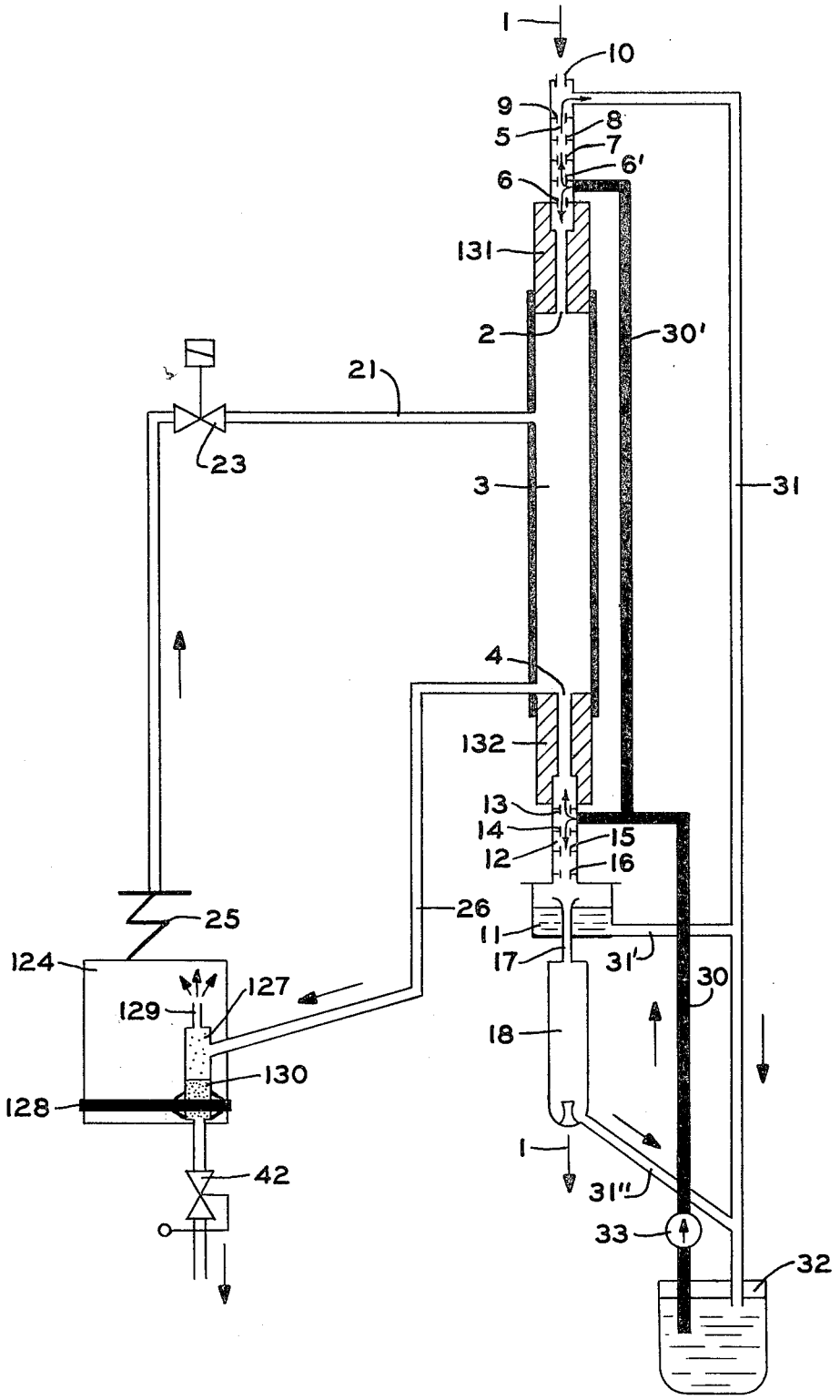
1
10
9
8
5
7
6'
6
131
2
30'
21
23
3
31
4
132
13
14
15
12
16
26
25
11
17
31'
124
127
30
129
18
130
128
1
42
31''
33
32

APPARATUS FOR HEAT TREATMENT OF SYNTHETIC YARNS AND FIBERS

BACKGROUND OF THE INVENTION

The invention relates to an apparatus for heat treatment of continuously moving synthetic yarns of fibers. Heating yarn or fibers by bringing the yarns into contact with a heated plate or roll is well-known in the art. The plate or roll can be heated by an electrical heater or it may be part of a closed vessel which is supplied with steam or in which steam is generated and condenses at the wall of the vessel along which the fiber is drawn. Improved efficiency with respect to heat transfer can be achieved by allowing the steam to condense at the fiber itself so that condensation heat is transmitted directly to the yarn rather than via a heated wall or roll. German Auslegeschrift No. 17 60 956 shows an apparatus of this kind where the yarn passes through an elongated vessel filled with saturated steam which condenses on the moving yarn and transfers its heat to the yarn. In order to prevent the steam from escaping through the inlet and outlet ports of the vessel where the yarns enters and leaves the vessel, a labyrinth seal is provided at each end of the vessel and the central portion of each labyrinth seal is supplied with air under pressure with such pressure corresponding approximately to the pressure of the steam within the vessel.

It is an object of the present invention to avoid the noise caused by the pressurized air escaping from labyrinth seals to the outside and furthermore to eliminate the loss of energy caused by continuously escaping pressurized air.

SUMMARY OF THE INVENTION

These and other objects are solved by the invention as characterized in the appending claims. Blocking liquid does not escape from the vessel but is circulated in a closed thermally isolated loop so that there will be neither generated noise nor remarkable losses of energy caused in the blocking system. In many cases wetting of the yarn when moving through the inlet tube improves the effect of the heat treatment. Furthermore the yarn is not subject to a sudden change of temperature when entering or leaving the vessel.

BRIEF DESCRIPTION OF THE DRAWING

The invention and further details thereof will now be described in connection with an embodiment shown schematically in the single drawing.

DETAILED DESCRIPTION OF THE INVENTION

A fiber of yarn 1 which is to be treated with heat enters an upright long steam vessel 3 through inlet 2 and leaves vessel 3 through outlet opening 4. The travel path of fiber 1 upstream of inlet opening 2 is surrounded by tube 5 having several apertures 6–9. The outer end of tube 5 is provided with inlet hole 10. Mounted between tube 5 and the upper end of steam vessel 3 is a tube-like intermediate piece 131 which thermally isolates tube 5 from steam vessel 3. This intermediate piece 131 is made of a thermally isolating material such as pressed ceramic, porcelain or a synthetic material such as teflon. At the outlet side of the vessel a corresponding thermally isolating intermediate piece 132 is provided. It ports into a tube 12 which in its lower portion 11 has an increased diameter forming a collecting tank for the blocking liquid. Several apertures 13–16 are provided within tube 12. The yarn leaves tube 12 through standing tube 17 which ports into a collector tube 18 of increased diameter. By ballooning the yarn in this collecting tube 18, any residual liquid is removed from the yarn or fiber.

At about half of the height of the steam vessel 3, steam supply tube 21 ports into the vessel and is connected via control valve 23 to steam generator 124 through steam super heater 25. The condensate accumulating in the lower portion of steam vessel 3 is removed through condensate return pipe 26 into distillation separator 127 which is located within steam generator 124 and is provided with additional heating device 128 preferably in the form of an electrical heater. The steam condensate is distilled off and via tube 129 enters the vessel of the steam generator 124. Bits of yarn or any treating liquid accompanying the yarn accumulate in the lower portion 130 of the distillation separator 127 and are removed from time to time through a float valve 42.

In order to prevent steam leaving steam vessel 3 through yarn inlet opening 2 or yarn outlet opening 4, respectively, a blocking liquid chamber is provided at the yarn inlet side as well as at the yarn outlet side. These blocking chambers are formed by tubes 5 and 12, respectively. Water is used as the blocking liquid and is maintained under a pressure which is about 0.2–0.5 bar higher than the pressure in steam vessel 3. At the inlet side, blocking liquid is supplied to tube 5 between first aperture 6 and second aperture 6'. At the outlet side, blocking liquid (water) is fed into tube 12 between first aperture 13 and second aperture 14. By means of the subsequent apertures 6' to 9 and 14 to 16, respectively, the water pressure is reduced stepwise to atmospheric pressure. At inlet opening 10 no water leaves tube 5 to the outside. This blocking liquid rather leaves tube 5 via blocking liquid return pipe 31 which is connected to tube 5 between aperture 9 and inlet opening 10. Return pipe 31 leads to blocking liquid collector 32. On the yarn outlet side of vessel 3, blocking water enters 12 between first and second apertures 13 and 14, respectively. The blocking water supply, however, could also be connected at each side of the vessel between the first aperture and the inlet or outlet opening, respectively. The pressure of the blocking water supplied to tube 12 is again stepwise reduced by means of subsequent apertures 14 to 16 until it reaches atmospheric pressure. The stand pipe 17 simultaneously forming the outlet opening for the yarn projects with its upper end out of the water level within collector 11 so that yarn 1 enters collector tube 18 with almost no blocking liquid. Within the extended diameter of collector 18 any remaining water is removed from the yarn by means of ballooning. From lower portion 11 of tube 12 the accumulated water flows through return pipe 31' to the main return pipe and from there to collector tank 32. By means of a further return pipe 31'' the lower portion of collector tube 18 is also connected to blocking water return pipe 31. Pump 33 is used for moving the blocking water from collector tank 32 into the blocking water supply pipe 30. The pressure of the pump is chosen such that a small amount of blocking water enters the lower portion of steam vessel 3 via the yarn outlet opening 4. From this lower portion of vessel 3 the blocking water flows via condensate pipe 26 into distillation separator 127. In this way steam from vessel 3 is prevented safely from entering blocking liquid tube 12 where it otherwise could possibly cause evaporation of the blocking liquid. Such evaporation of the blocking liquid would cause heat losses and would reduce the blocking effect of the liquid barrier. For the same purpose the thermally isolating intermediate pieces 131 and 132 are provided between the end portions of steam vessel 3 and tubes 5 and 12, respectively. By means of these thermal isolators 131 and 132 the blocking liquid circuit is thermally decoupled from the steam circuit. This thermal decoupling guarantees that the heat energy supplied to steam vessel 3 is not removed via the blocking liquid circuit but is completely used for heating the yarn. This is accomplished by the saturated steam within vessel 3 condensing on yarn 1 and therewith transmitting its condensating heat to the yarn. If it is desired that the yarn leaves collector tube 13 with a low temperature, a cooling device, might be provided within blocking liquid collector 32. Valve 42 simultaneously is used for level control within steam generator 124. The steam loop as well as the blocking liquid loop are required only once for several treatment vessels 3 of a texturizing machine or other yarn treating machine. The tubing of the steam loop and of the blocking liquid loop are thermally isolated to keep thermal losses as low as possible.

The fiber, for instance, by means of a needle is drawn through the apertures, the isolating pieces, the steam vessel and the collector tube or are inserted into the apparatus by opening the apparatus which in this case is divided into two hinged portions. For starting operation of the apparatus the blocking liquid loop at first remains switched off and steam is supplied into vessel 3 via tube 21. By that way any air within vessel 3 is removed. Then the blocking liquid loop is switched on by means of pump 33 and sealing of the steam vessel 3 to the outside is accomplished. A temperature controller (not shown) is connected to a temperature sensor measuring the temperature within steam vessel 3 and controls steam generator 124 and therewith the temperature of the saturated steam in accordance with the desired value required for successful treatment of the yarn. This saturated steam is supplied to steam vessel 3 via pipe 21. Since only the steam vessels 3 together with intermediate pieces 131, 132 and tubes 5, 12 and 18 have to be provided for each yarn treating station and all other parts of the steam loop and the blocking liquid loop are required only once for a large number of yarn treating stations provided in a yarn treating machine, the expenditure for the apparatus is low compared with its highly effective heat treatment properties. Preferably one of the vessels 3 is used as pilot vessel for the temeperature and pressure regulation. The amount of steam depends on the amount of neat absorbed by the yarn and on the heat losses of the apparatus. These losses can be kept low by appropriate isolation of the steam and liquid loops.

The embodiments of the invention in which an exclusive property or right is claimed are defined as follows:

1. Apparatus for heat treatment of continuously moving synthetic yarns or fibers, characterized as follows:

at least one elongated thermally isolated upright vessel connected to a steam generator having at its upper end an inlet opening and at its lower end an outlet opening for the yarn;

a tube located at each corresponding end of said vessel and outside of said openings and having a corresponding hole therein for allowing said yarn to pass therethrough and through said vessel;

each of said tubes having several apertures in series along the travel path of the yarn;

the space between the inlet opening and one of the first two apertures of one of said tubes and between the outlet opening and one of the first two apertures of said other tube is connected to a blocking liquid supply pipe;

the space between said hole and one of said apertures in each tube being connected to a blocking liquid return pipe which ports into a liquid collector tank;

a pump inserted between said collector tank and said blocking liquid supply pipe; and, said apertures serving to reduce the pressure of the supplied blocking liquid to almost atmospheric pressure at said holes which allow the yarn to enter and to leave the apparatus.

2. The apparatus according to claim 1 characterized in that a thermally isolation intermediate piece surrounding the traveling path of the yarn is provided at each end of the vessel between said tube and the adjacent end of the vessel.

3. The apparatus according to claim 2 characterized in that the intermediate pieces are ceramic or porcelain.

4. The apparatus according to claim 2 characterized in that the intermediate pieces are made of a synthetic material such as teflon.

5. The apparatus according to claim 2 comprising a steam supply pipe connected to an upper or intermediate portion of said vessel and comprising a condensate return pipe leading from the lower end of the vessel to an evaporator provided in a steam generator.

6. The apparatus according to claim 5 wherein at the yarn outlet side below the last aperture a collector tube of enlarged diameter is provided and is connected with its lower end to the blocking liquid return pipe.

7. The apparatus according to claim 1 comprising a steam supply pipe connected to an upper or intermediate portion of said vessel and comprising a condensate return pipe leading from the lower end of the vessel to an evaporator provided in a steam generator.

8. The apparatus according to claim 7 wherein at the yarn outlet side below the last aperture a collector tube of enlarged diameter is provided and is connected with its lower end to the blocking liquid return pipe.

9. The apparatus according to claim 1 wherein at the yarn outlet side below the last aperture a collector tube of enlarged diameter is provided and is connected with its lower end to the blocking liquid return pipe.

* * * * *